US010260517B2

(12) United States Patent
Juarez Ortega et al.

(10) Patent No.: US 10,260,517 B2
(45) Date of Patent: Apr. 16, 2019

(54) FIXED SUCTION CHAMBER WITH REAR AND FRONT SEAL REMOVAL

(71) Applicant: GE Oil & Gas ESP, Inc., Oklahoma City, OK (US)

(72) Inventors: Pedro Arturo Juarez Ortega, Oklahoma City, OK (US); Andrew Michael Nelson, Oklahoma City, OK (US); Alan Spicer, Oklahoma City, OK (US); Michael Campbell, Oklahoma City, OK (US)

(73) Assignee: GE Oil & Gas ESP, Inc., Oklahoma City, OK (US)

( * ) Notice: Subject to any disclaimer, the term of this patent is extended or adjusted under 35 U.S.C. 154(b) by 0 days.

(21) Appl. No.: 13/949,919

(22) Filed: Jul. 24, 2013

(65) Prior Publication Data

US 2015/0030470 A1 Jan. 29, 2015

(51) Int. Cl.

| | |
|---|---|
| ***F04D 13/02*** | (2006.01) |
| ***F04D 29/08*** | (2006.01) |
| ***F04D 29/60*** | (2006.01) |

(52) U.S. Cl.

CPC ..... *F04D 29/086* (2013.01); *F04D 13/021* (2013.01); *F04D 29/60* (2013.01); *F04D 29/605* (2013.01)

(58) Field of Classification Search

CPC ..... F04D 13/06; F04D 29/603; F04D 29/62; F04D 29/628; F04D 29/08; F04D 29/086; F04D 29/10; F04D 29/106; F04D 29/12; F04D 29/126; F16J 15/3464; F16J 15/3268

USPC ..... 417/360; 277/370, 371, 375

See application file for complete search history.

(56) References Cited

U.S. PATENT DOCUMENTS

| | | | | |
|---|---|---|---|---|
| 1,475,676 A | | 11/1923 | Bell et al. | |
| 2,370,964 A | * | 3/1945 | Janette | F16J 15/38 277/375 |
| 2,945,709 A | | 7/1960 | Freed et al. | |
| 3,059,582 A | | 10/1962 | Greene et al. | |

(Continued)

FOREIGN PATENT DOCUMENTS

WO 2009018560 5/2009

OTHER PUBLICATIONS

Search Report for PCT/US2014/047032, dated Oct. 20, 2014.

*Primary Examiner* — Philip E Stimpert

(74) *Attorney, Agent, or Firm* — Crowe & Dunlevy, P.C.

(57) ABSTRACT

A suction chamber for use in a horizontal fluid pumping system is supported by a fixed vertical bracket, which is attached to a platform. The suction chamber is positioned between a motor and a pump in the horizontal pumping system. The pumping system may also include a thrust bearing chamber positioned between the motor and the suction chamber. The pumping system may also include a bearing chamber adapter positioned between the thrust bearing chamber and the suction chamber. The suction chamber has a suction chamber pump end and a suction chamber motor end. The suction chamber enables both motor-end seal removal and pump-end seal removal. In both motor end seal removal and pump end seal removal, the suction chamber of the invention remains connected to the vertical bracket. The pumping system may also include an integrated lifting device connected to the vertical bracket to lift the thrust bearing assembly.

14 Claims, 13 Drawing Sheets

(56) References Cited

U.S. PATENT DOCUMENTS

| | | | | |
|---|---|---|---|---|
| 3,678,559 | A * | 7/1972 | Zilkalns | 29/281.6 |
| 4,211,519 | A | 7/1980 | Hogan | |
| 5,344,291 | A | 9/1994 | Antkowiak | |
| 5,779,434 | A | 7/1998 | De Long | |
| 6,270,316 | B1 | 8/2001 | Precetti | |
| 6,461,115 | B1 * | 10/2002 | Ferrier et al. | 417/53 |
| 7,074,017 | B2 * | 7/2006 | Coray | F04D 13/021 29/888.021 |
| 7,104,766 | B2 | 9/2006 | Mascola | |
| 7,520,720 | B2 | 4/2009 | Welch | |
| 7,559,753 | B2 | 7/2009 | Burrage | |
| 2003/0219347 | A1 | 11/2003 | Mascola | |
| 2007/0086906 | A1 | 4/2007 | Horley et al. | |
| 2008/0085185 | A1 | 4/2008 | Towsley et al. | |
| 2009/0214332 | A1 | 8/2009 | Towsley et al. | |
| 2010/0284830 | A1 | 11/2010 | Burns, Sr. et al. | |
| 2011/0123380 | A1 | 5/2011 | Thomas et al. | |
| 2011/0142599 | A1 | 6/2011 | Burgess et al. | |

* cited by examiner

FIXED SUCTION CHAMBER WITH REAR AND FRONT SEAL REMOVAL

FIELD OF THE INVENTION

This invention relates generally to the field of horizontal pumping systems, and more particularly to a fixed position suction chamber optimized for allowing duo-directional seal removal in horizontal pumping systems.

BACKGROUND

Horizontal pumping systems are used in various industries for various purposes. For example, in the oil and gas industry horizontal pumping systems are used to pump fluids, such as water separated from oil, to a selected destination, such as a tank or disposal well. Typically these horizontal pumping systems include a pump, a motor, and a suction chamber positioned between the pump and the motor. Often a thrust bearing chamber is also included between the motor and the suction chamber.

The suction chamber typically includes a shaft sealing device to prevent fluid from leaking out of the motor or the thrust bearing chamber end of the suction chamber. The sealing device wears during time and must sometimes be removed and replaced.

The prior art methods for removing the sealing device include a pump-side seal removal or a motor-side seal removal. To remove the sealing device utilizing a present method for pump-side removal, the fasteners holding the pump are removed, the drop off element between the pump discharge and the pipe line must be removed, and the pump and a removable plate, located at the front of the suction chamber between the pump base and the suction chamber flange, are moved away from the motor allowing sufficient space to access the seal. Once the pump and removable plate are moved, and the sealing device has been replaced, the pump and removable plate are moved back, the drop off element is replaced, and the fasteners are tightened to the requisite torque to hold the pump in place. Thus, alignment of the pump is regained.

However, in the pump-side removal method, if the thrust bearing chamber needs to be replaced, numerous steps are required. Thus, to remove the thrust bearing chamber, the pump discharge flange and suction chamber inlet flange of the pipe line must be disconnected, the drop off element between the pump discharge and the pipe line must be removed, the suction chamber must be disengaged from the chamber adapter, the seal collar must be released from the shaft, the suction chamber and pump must be moved away from the motor, and finally, the thrust bearing chamber is unfastened and removed from the vertical bracket. Although the vertical bracket is not disturbed, this process is complicated and results in an extended down-time.

Referring now to FIGS. 1 and 2, depicted therein are prior art suction chambers used in prior art pump-side removal methods. FIG. 1 shows a suction chamber 500 including a cartridge seal 502. The suction chamber 500 includes a housing 504, which includes a suction chamber motor end 506 and a suction chamber pump end 508. A permanent pump end plate 510 is included at the suction chamber pump end 508. A permanent motor end plate 512 is included at the suction chamber motor end 506. Additionally, a removable pump end plate, also referred to as a pump adapter plate 514, is positioned at the suction chamber pump end 508 and secured to the permanent pump end plate 510 via a plurality of fasteners or other means known in the art. The cartridge seal 502 is mounted onto the permanent motor end plate 512 and surrounds a shaft 516 disposed through the housing 504 of the suction chamber 500. Also depicted in FIG. 1 is a pump inlet line 518 connected to the suction chamber 500.

FIG. 1 also shows a bearing chamber adapter 520, which may be connected to the suction chamber 500 via a plurality of fasteners or other means known in the art. A thrust bearing chamber 522 may also be connected to the bearing chamber adapter 520. The cartridge seal 502 prevents fluid from passing through the suction chamber motor end 506 and thus prevents any damage to the thrust bearing chamber 522 or motor (not depicted in FIG. 1) because of contamination from the fluid.

To service the cartridge seal 502 of the suction chamber 500, several steps are required. First, the drop off element (not depicted in FIG. 1) between the pump discharge port (not depicted in FIG. 1) and the pipeline (not depicted in FIG. 1) is removed. Next, the pump adapter plate 514 is disconnected from the suction chamber 500. Then, the pump support hardware (not depicted in FIG. 1) is loosened, and the pump is moved away from the motor to create the requisite space to allow access to the suction chamber pump end 508 to access the cartridge seal 502. Thus, the design of suction chamber 500 requires the removal and moving of a large number of parts for service to take place, including two or more platforms with built-in jacks and rollers positioned below the pump and between the pump supports. If the thrust bearing chamber 522 must be accessed at the same time the cartridge seal 502 is serviced, the entire suction chamber 500 must be removed because it will no longer be supported on either side.

Now turning to FIG. 2, depicted therein is a prior art suction chamber 524 including a component seal 526. The suction chamber 524 includes a chamber housing 528, which includes a suction chamber motor end 530 and a suction chamber pump end 532. A pump end plate 534 is permanently connected at the suction chamber pump end 532. A motor end plate 536 is permanently connected at the suction chamber motor end 530. Additionally, a removable pump end plate, also referred to as a pump adapter plate 538, is positioned at the suction chamber pump end 532 and secured via a plurality of fasteners or other means known in the art.

Continuing with FIG. 2, also shown therein is a bearing chamber adapter 540. The bearing chamber adapter 540 includes an adapter housing 542, which includes an adapter motor end 544 and an adapter pump end 546. A permanent adapter motor end plate 548 is located at the adapter motor end 544 and a permanent adapter pump end plate 550 is located at the adapter pump end 546. A thrust bearing chamber 552 may also be connected to the bearing chamber adapter 540. A component seal plate 554 is connected to the permanent adapter pump end plate 550.

The component seal plate 554 includes the component seal 526 positioned around a shaft 556. The component seal 526 includes a snap ring 558, a seal spring 560, a stationary sealing seat 562, a rotary sealing face 564, and other miscellaneous, mostly elastomeric sealing and retaining devices. The component seal 526 prevents fluid from passing through the motor end plate 536 thus, preventing any damage to the thrust bearing chamber 552 or the motor due to contamination from the fluid. Also depicted in FIG. 2 is a pump inlet line 566 connected to the suction chamber 524.

The design of suction chamber 524 allows for seal removal through thrust bearing chamber 552 removal. Removal of the component seal 526 for servicing first requires that the drop off element (not depicted in FIG. 2)

between the pump discharge port (not depicted in FIG. 2) and the pipeline (not depicted in FIG. 2) is removed. Next, the pump inlet line 566 must be disconnected from the piping feeding the pumping system. Next, the pump support hardware (not depicted in FIG. 2) is loosened, and the bearing chamber adapter 540 is disconnected from the suction chamber 524 and the pump and suction chamber 524 are moved away from the motor to create the requisite space to allow removal of the bearing chamber adapter 540, thrust bearing chamber 552, shaft 556 and component seal plate 554 from the system. In some cases, if the suction chamber 524 reaches the first pump support before completing the total travel distance allowed by the drop off element, then the suction chamber 524 must be entirely removed from the horizontal pumping system. Next, the thrust bearing chamber 552 and bearing chamber adapter 540 are dismounted from the bracket (not depicted in FIG. 2) and the bearing chamber adapter 540 and the component seal 526 are disconnected from the thrust bearing chamber 552. Thus, the design of suction chamber 524 requires the removal and moving of a large number of parts for service to take place, including two or more platforms with built-in jacks and rollers positioned below the pump and between the pump supports.

In the prior art method for motor-side seal removal, a spacer coupling is removed or, if there is no spacer coupling, the motor is pushed away from the pump. Next, the thrust bearing chamber is disconnected from the bracket, and the bearing chamber adapter is unbolted from the suction chamber. Then, the thrust bearing chamber and bearing chamber adapter are tilted until both elements clear the vertical bracket and motor.

If the thrust bearing chamber needs seal service, the thrust bearing chamber and bearing chamber adapter are removed from the bracket. These are removed utilizing a crane or other similar lifting device. When they are installed back in place, the load acting on the suction chamber inlet flange from the pumping system connected to the pipe line often pushes the suction chamber out of alignment. There is the potential for higher vibrations and a resulting shortening of the life of the components.

Thus, there is a need for a method and apparatus, which will provide a true fixed-point to enable the components of the pumping system to regain alignment once they are installed back into place. There is also the need for a duo-directional seal removal method and apparatus that will enable the seal to be serviced from either the motor end or the pump end depending on the service needs. Additionally, there is the need for an integrated lifting device for easy, low cost removal of the thrust bearing motor chamber and bearing chamber adapter for motor end seal service. Furthermore, there is the need for a duo-directional method and apparatus having a suction chamber mounted on a vertical bracket mounted on a platform, so that the suction chamber is fixed, and when service is applied to the pumping system, the loads acting upon the suction chamber inlet flange do not affect the alignment of the suction chamber when it is disconnected from the bearing chamber adapter. It is to these and other deficiencies in the prior art that the present invention is directed.

SUMMARY OF THE INVENTION

In a preferred embodiment, the present invention includes a suction chamber for use in a horizontal fluid pumping system. The suction chamber is supported by a vertical bracket, and the vertical bracket is attached to a platform. The suction chamber is positioned between a motor and a pump in the horizontal pumping system. The pumping system may also include a thrust bearing chamber positioned between the motor and the suction chamber. The pumping system may also include a bearing chamber adapter positioned between the thrust bearing chamber and the suction chamber. The suction chamber has a suction chamber pump end and a suction chamber motor end. A shaft, or shaft segments, extend from the motor, into the thrust bearing chamber, through the suction chamber and into the pump.

The suction chamber of the preferred embodiment enables both motor-end seal removal and pump-end seal removal (duo-directional seal removal). In both motor end seal removal and pump end seal removal, the suction chamber of the invention remains connected to the vertical bracket. This prevents misalignment generated by loads acting upon the suction chamber inlet flange.

The pumping system may also include an integrated lifting arm mounted to the vertical bracket. The mounting of the integrated lifting arm to the vertical bracket enables low cost and easy removal of the thrust bearing chamber and bearing chamber adapter to allow for motor-end seal removal.

DETAILED DESCRIPTION OF THE PREFERRED EMBODIMENT

Figure 1:
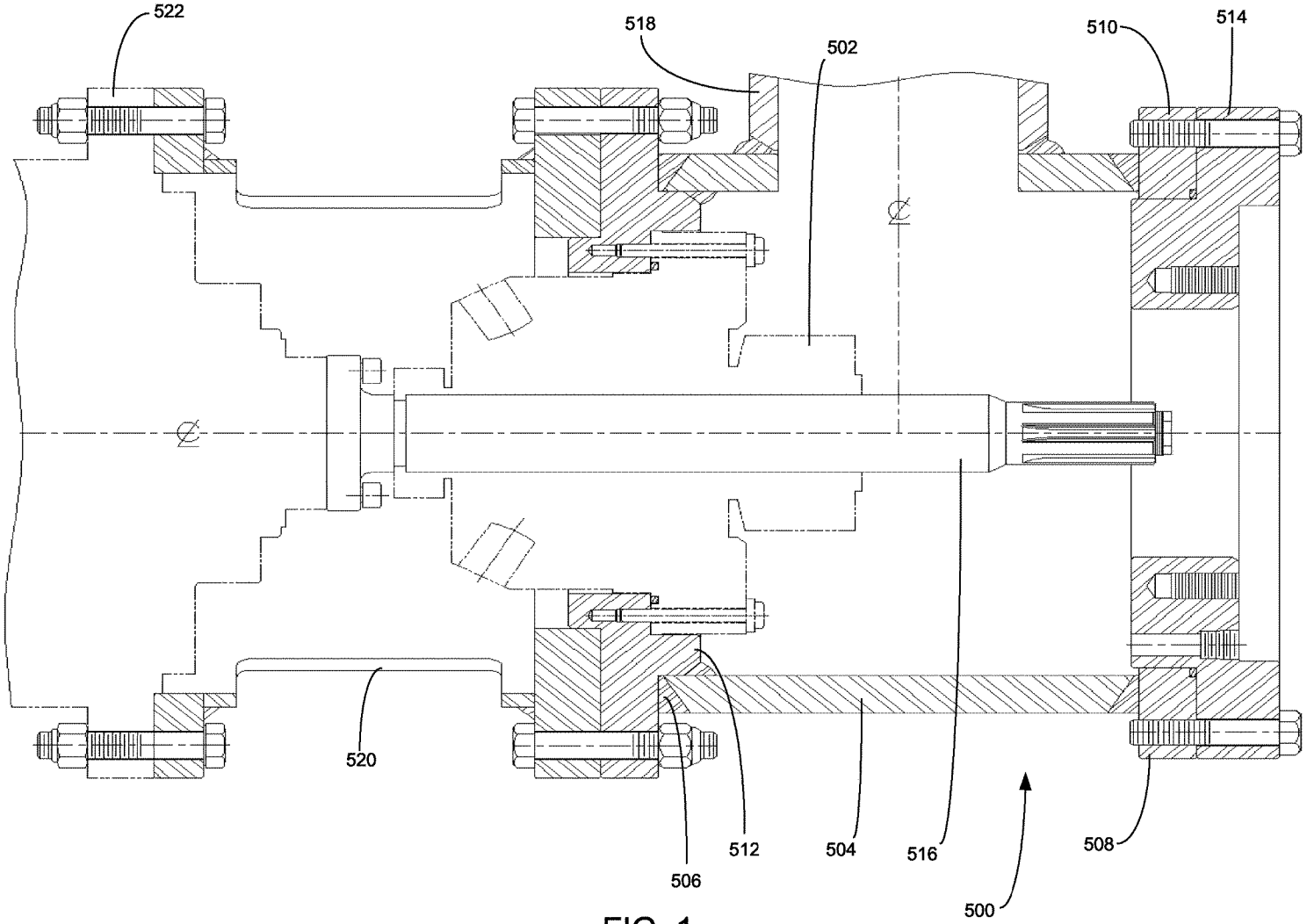
FIG. 1 PRIOR ART
FIG. 1 is a cross-sectional view of a prior art suction chamber with a cartridge seal assembly.
Figure 2:
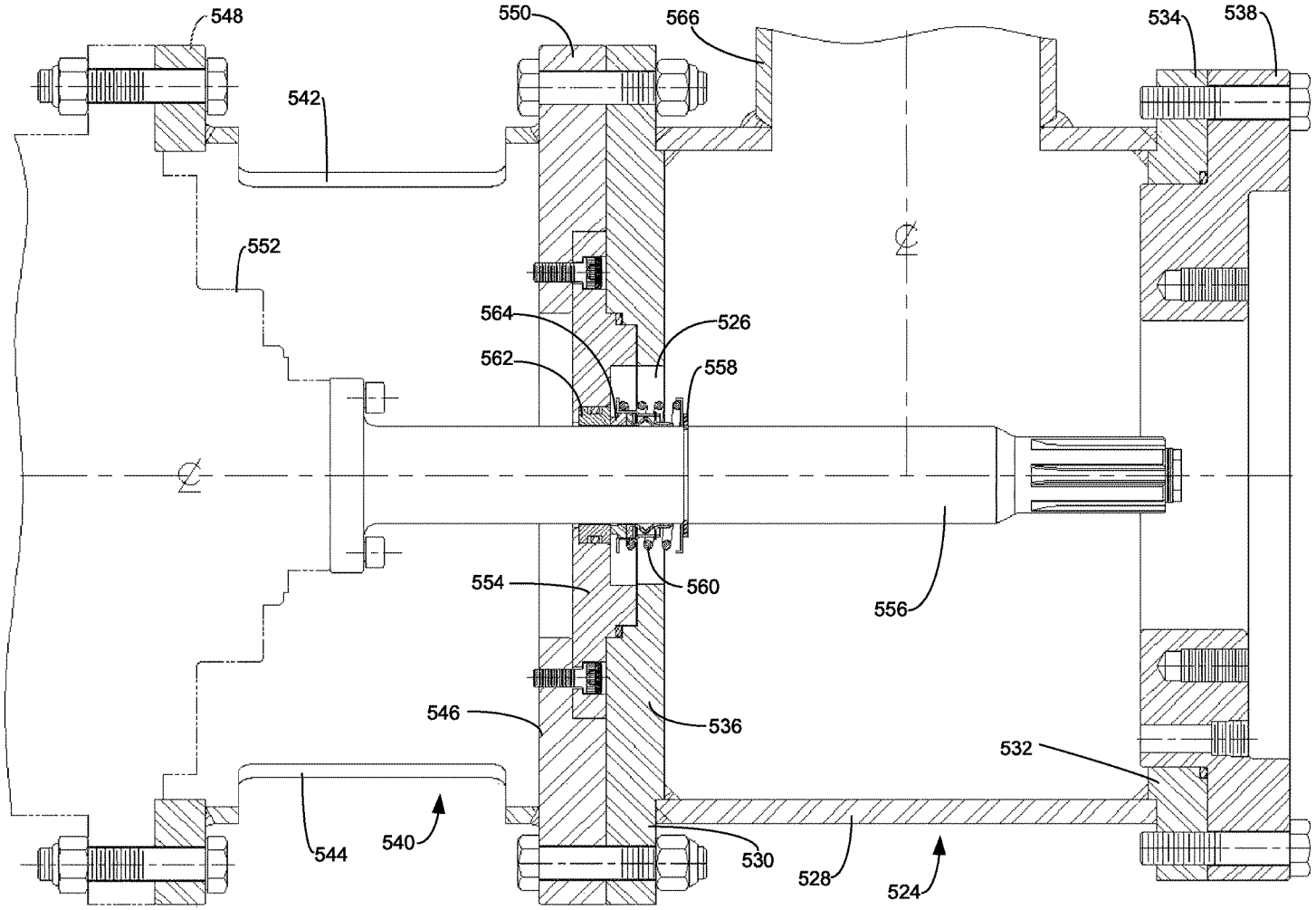
FIG. 2 PRIOR ART
FIG. 2 is a cross-sectional view of a prior art suction chamber with a component seal assembly.
Figure 3:
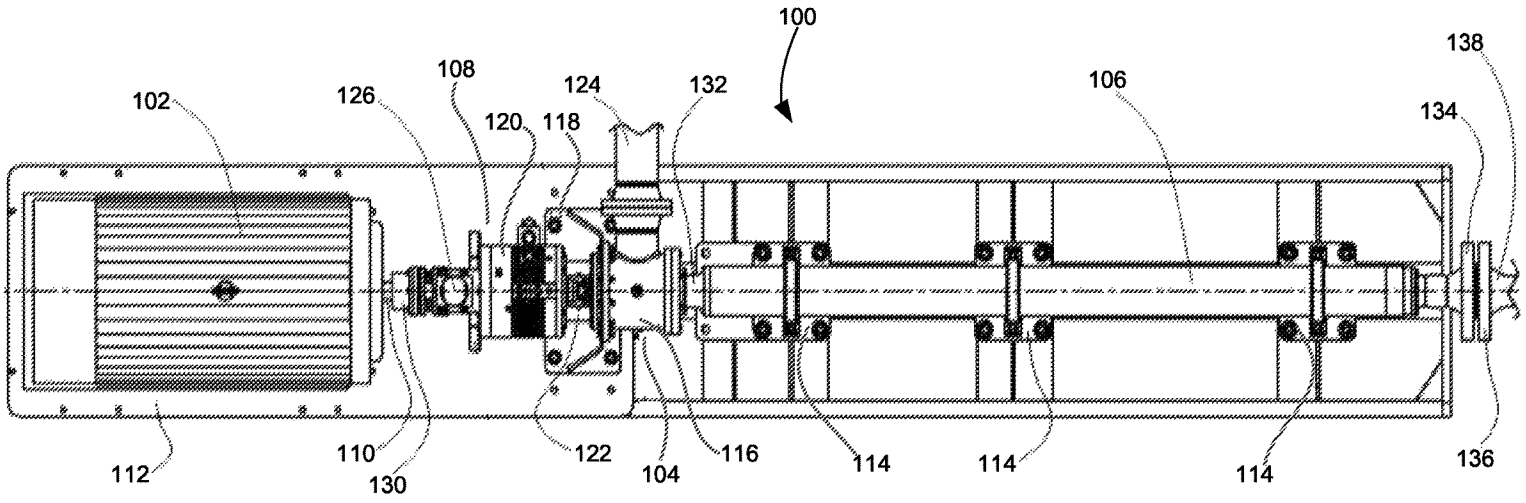
FIG. 3 is a top view of a horizontal pumping system constructed in accordance with a presently preferred embodiment.
Figure 4:
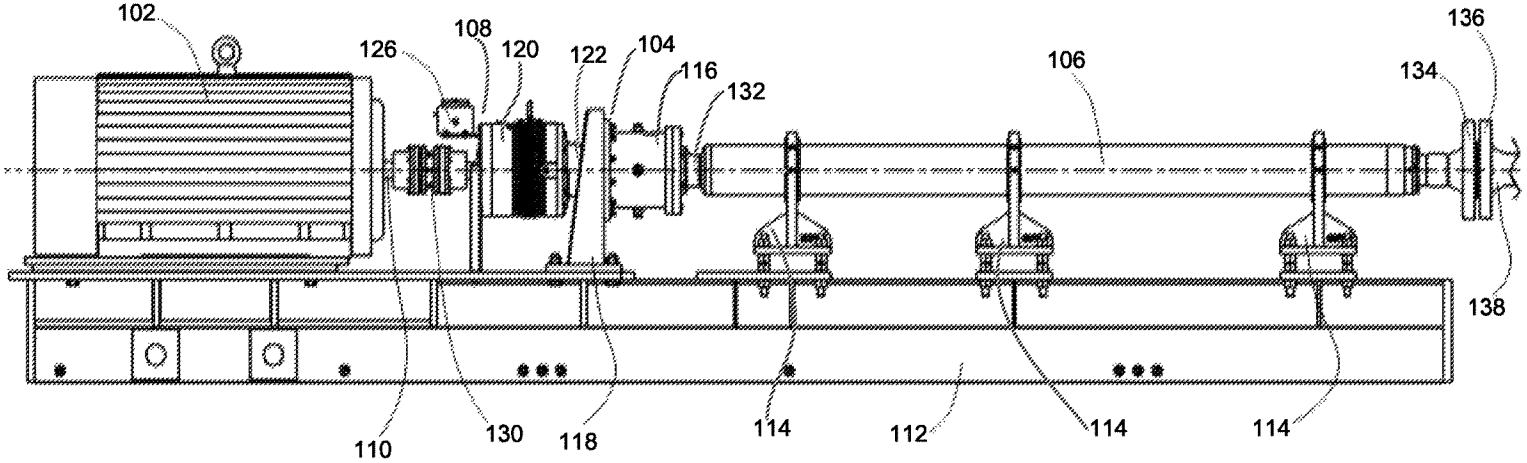
FIG. 4 is a side view of the horizontal pumping system of FIG. 3.

In accordance with a preferred embodiment of the present invention, FIGS. 3 and 4 show a top and side view of a horizontal pumping system 100. The horizontal pumping system 100 includes a motor 102, a suction chamber assembly 104, a pump 106, a thrust bearing assembly 108, and a drive shaft 110. The motor 102 may be mounted to a platform 112. The pump 106 may be supported by one or more pump supports 114. The suction chamber assembly 104 includes a suction chamber 116, a bearing chamber adapter 122 mounted to the suction chamber 116, and a vertical bracket 118. The thrust bearing assembly 108 of the horizontal pumping system 100 includes a thrust bearing chamber 120 supported by the bearing chamber adapter 122. The suction chamber 116 is mounted to the vertical bracket 118 and has an inlet pipe 124. The horizontal pumping system 100 may also include a vibration sensor 126.

In the preferred embodiment, the drive shaft 110 may include a plurality of drive shaft segments 128 connected together via one or more couplings 130 or by other means known in the art. It will be understood that the plurality of drive shaft segments 128 and the one or more couplings 130 may be of different sizes and of any type known in the art. The drive shaft 110 extends from the motor 102, through the thrust bearing chamber 120, through the suction chamber 116 and into the pump 106. The pump 106 has an inlet end 132 and a discharge end 134. The inlet end 132 is connected to the suction chamber 116. A discharge head 136 may be connected to the discharge end 134 of the pump 106. A drop off element 138 may be connected to the discharge head 136. The drop off element 138 may be a flexible hose, a flexible coupling or any other type of suitable element known in the art.

The operation of the horizontal pumping system 100 is as follows. The inlet pipe 124 delivers fluid to the horizontal pumping system 100. The fluid may be water, oil, other fluids which have been separated from oil that has been produced from a well, or any other fluid capable of pumping. The fluid passes through the suction chamber 116 into the inlet end 132 of the pump 106 and then out of the discharge end 134 of the pump 106 into the drop off element 138. The fluid is then delivered to a tank, a disposal well or any other desired reservoir or location. If the fluid in the horizontal pumping system 100 begins to leak in a direction toward the motor 102, which may be closer in proximity to the suction chamber 116 than that which is depicted in FIGS. 3 and 4, then the motor 102 can be damaged. Such leaks may also cause environmental contamination. Thus, it is necessary to prevent or mitigate such leakage by servicing and maintaining the rotating seals located within the horizontal pumping system 100.

Figure 5:
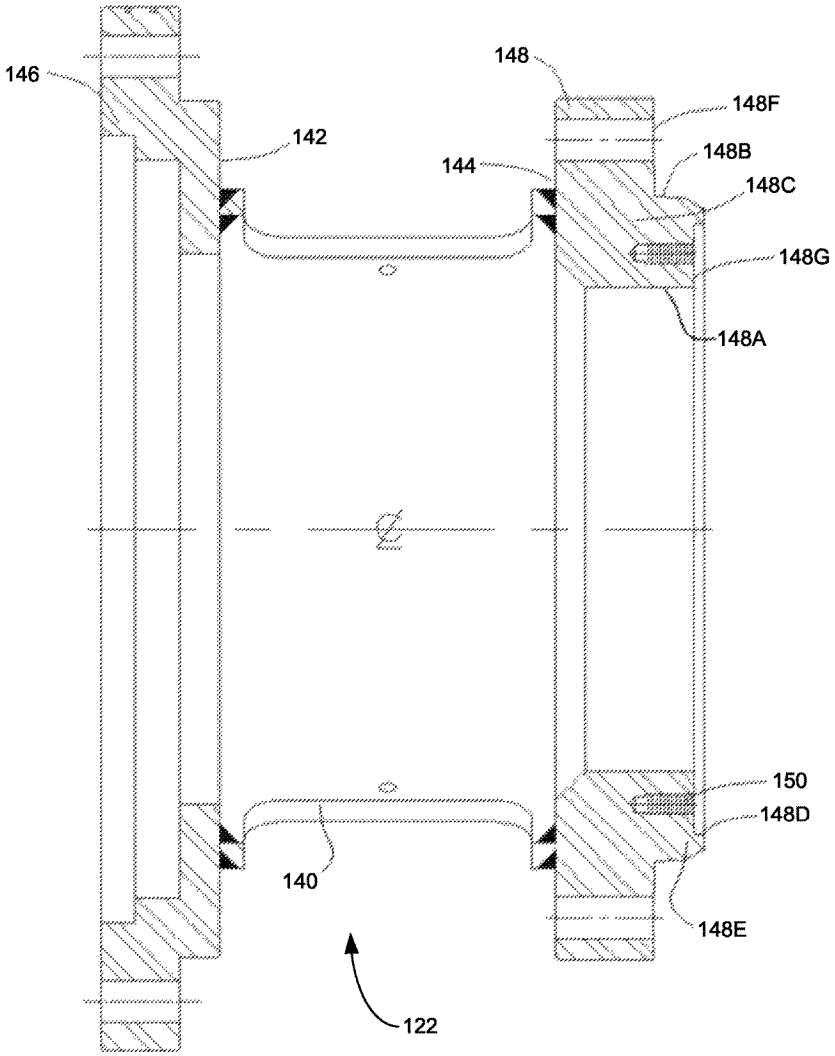
FIG. 5 is a cross-sectional view of a bearing chamber adapter constructed in accordance with a presently preferred embodiment

Turning to FIG. 5, shown therein is a cross sectional view of the bearing chamber adapter 122 constructed in accordance with a preferred embodiment. The bearing chamber adapter 122 includes an adapter housing 140, which includes an adapter motor end 142 and an adapter pump end 144. An adapter motor end plate 146 is connected at the adapter motor end 142 of the adapter housing 140 via welding, fasteners or by other means known in the art. An adapter pump end plate 148 is connected at the adapter pump end 144 of the adapter housing 140 via welding, fasteners or by other means known in the art.

The adapter motor end plate 146 is shaped to connect with the thrust bearing chamber 120 (not shown in FIG. 5). The adapter pump end plate 148 has a first inner diameter 148A and a second inner diameter 148B displaced outwardly therefrom. A first shoulder 148C is defined by and extends between the first inner diameter 148A and the second inner diameter 148B. The adapter pump end plate 148 defines an outer diameter 148D displaced outwardly from the first inner diameter 148A without reaching the second inner diameter 148B. A second shoulder 148E is defined by and extends between diameter 148B and 148D. The first adapter shoulder 148C has a first adapter mating surface 148F located adjacent to the second adapter inner diameter 148B. The second adapter shoulder 148E has a second adapter mating surface 148G. The second mating adapter surface 148G includes a circular bolt pattern 150.

Figure 6:
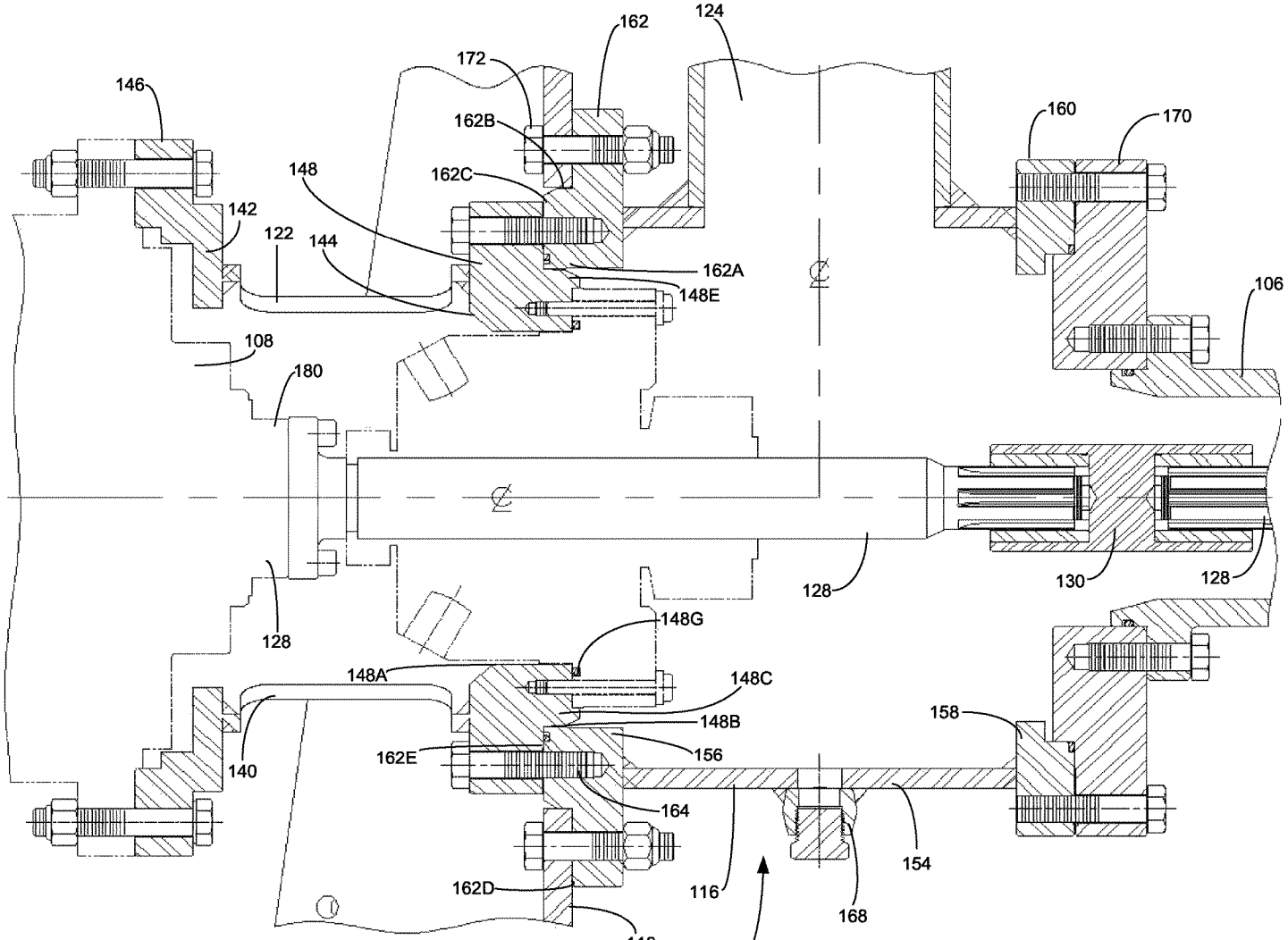
FIG. 6 is cross-sectional view of a suction chamber assembly constructed in accordance with a presently preferred embodiment and including a cartridge seal assembly.

Now referring to FIG. 6, shown therein is a suction chamber assembly 104 including components mounted onto the suction chamber 116. The suction chamber assembly 104 includes the suction chamber 116 and the vertical bracket 118. The vertical bracket 118 includes a bracket inner diameter 152. The suction chamber 116 includes a suction chamber housing 154, which includes a suction chamber motor end 156 and a suction chamber pump end 158. A pump end plate 160 is connected at the suction chamber pump end 158 of the suction chamber housing 154 via welding, fasteners or by other means known in the art. A motor end plate 162 is connected at the suction chamber motor end 156 of the suction chamber housing 154 via welding, fasteners or by other means known in the art.

The motor end plate 162 defines a first inner diameter 162A and a second inner diameter 162B displaced outwardly therefrom. A shoulder 162C is defined by and extends between diameters 162A and 162B. The shoulder 162C includes a first suction chamber mating surface 162D and a second suction chamber mating surface 162E. The first suction chamber mating surface 162D is located toward the middle of the motor end plate 162. The second suction chamber mating surface 162E represents the front of shoulder 162C of the motor end plate 162. A circular bolt pattern 164 of blind holes is located on the second suction chamber mating surface 162E. The suction chamber 116 of the invention may include one or more nozzles 168 for draining the suction chamber 116 during a service operation. The inlet pipe 124 channels fluid into the suction chamber housing 154.

The suction chamber 116 is mounted to the vertical bracket 118 by sliding shoulder 162C of the motor end plate 162 of the suction chamber 116 into the bracket inner diameter 152 of the vertical bracket 118, and then secured via welding, fasteners or by other means known in the art. In the preferred embodiment depicted in FIG. 6, bolts 172 are used to secure the suction chamber 116 to the vertical bracket 118.

The suction chamber assembly 104 may also include a removable end plate, or pump adapter plate 170. The pump adapter plate 170 is positioned at the suction chamber pump end 158 of the suction chamber 116 and connected to the pump end plate 160. The pump 106 is connected to the pump adapter plate 170. The pump 106 includes one of the plurality of drive shaft segments 128. The pump shaft segment 128 is connected to another one of the plurality of drive shaft segments 128 via one or more couplings 130 positioned within the suction chamber 116.

The first shoulder 148C of the adapter pump end plate 148 of the bearing chamber adapter 122 slides into the first inner diameter 162A of the motor end plate 162 of the suction chamber 116. An O-ring, sealing device or other suitable device known in the art, is positioned between the first adapter mating surface 148F of the adapter pump end plate 148 of the bearing chamber adapter 122 and the second suction chamber mating surface 162E of the motor end plate 162 of the suction chamber 116.

A cartridge seal assembly 176 is connected to the bearing chamber adapter 122 via fasteners or by other means known in the art (screws are shown in FIG. 6). When the cartridge seal assembly 176 is connected to the bearing chamber adapter 122, an O-ring, sealing device or other suitable device known in the art, is positioned between the second adapter mating surface 148G of the adapter pump end plate 148 and the cartridge seal assembly 176. The thrust bearing chamber 108 is connected to the adapter motor end 142 of the bearing chamber adapter 122. The thrust bearing chamber 108 includes one or more of the plurality of drive shaft segments 128. The thrust bearing chamber shaft 128 is connected to another one of the plurality of drive shaft segments 128 via a shaft adapter 180. It should be understood that the thrust bearing chamber shaft 128 could alternatively consist of a single shaft comprising the length of both the thrust bearing chamber 120 and the plurality of drive shaft segments 128.

Figure 12:
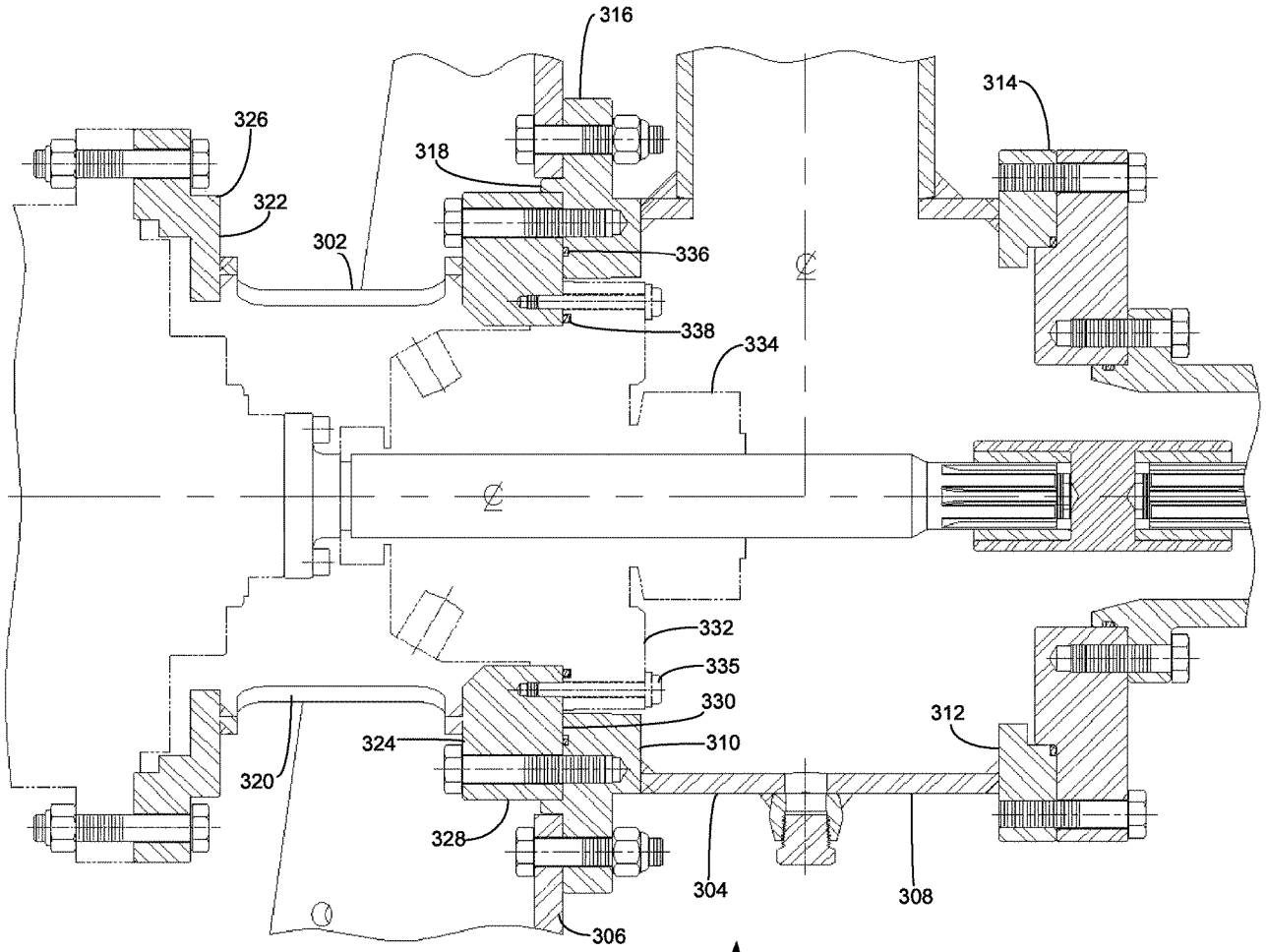
FIG. 12 is a cross-sectional view of an alternate preferred embodiment of a suction chamber assembly.

FIG. 12 shows an alternate embodiment of a suction chamber assembly 300 and a bearing chamber adapter 302 of the present invention. The suction chamber assembly 300 includes a suction chamber 304 and the vertical bracket 306. The suction chamber 304 includes a suction chamber housing 308, which includes a suction chamber motor end 310 and a suction chamber pump end 312. A pump end plate 314 is located at the suction chamber pump end 312 and is connected to the suction chamber housing 308 via welding, fasteners or by other means known in the art. A motor end plate 316 is located at the suction chamber motor end 310 and is connected to the suction chamber housing 308 via welding, fasteners or by other means known in the art.

The motor end plate 316 includes a shoulder 318 to allow the suction chamber 304 to be mated with the bearing chamber adapter 302. The bearing chamber adapter 302 includes an adapter housing 320, which includes an adapter motor end 322 and an adapter pump end 324. An adapter motor end plate 326 is located at the adapter motor end 322 and is connected to the adapter housing 320 via welding, fasteners or by other means known in the art. An adapter pump end plate 328 is located at the adapter pump end 324 and is connected to the adapter housing 320 via welding fasteners or by other means known in the art.

A flat surface 330 of the adapter pump end plate 328 faces both the motor end plate 316 of the suction chamber 304 and a seal plate 332 of a cartridge seal assembly 334. The cartridge seal assembly 334 is connected to the adapter pump end plate 328 via fasteners 335 or by other means known in the art. A first O-ring 336 is positioned between the adapter pump end plate 328 and the motor end plate 316. A second O-ring 338 is positioned between the cartridge seal assembly 334 and the adapter pump end plate 328. The alternate embodiment of the suction chamber 300 may facilitate installation and alignment of the suction chamber 300 with the bearing chamber adapter 302.

Figure 7:
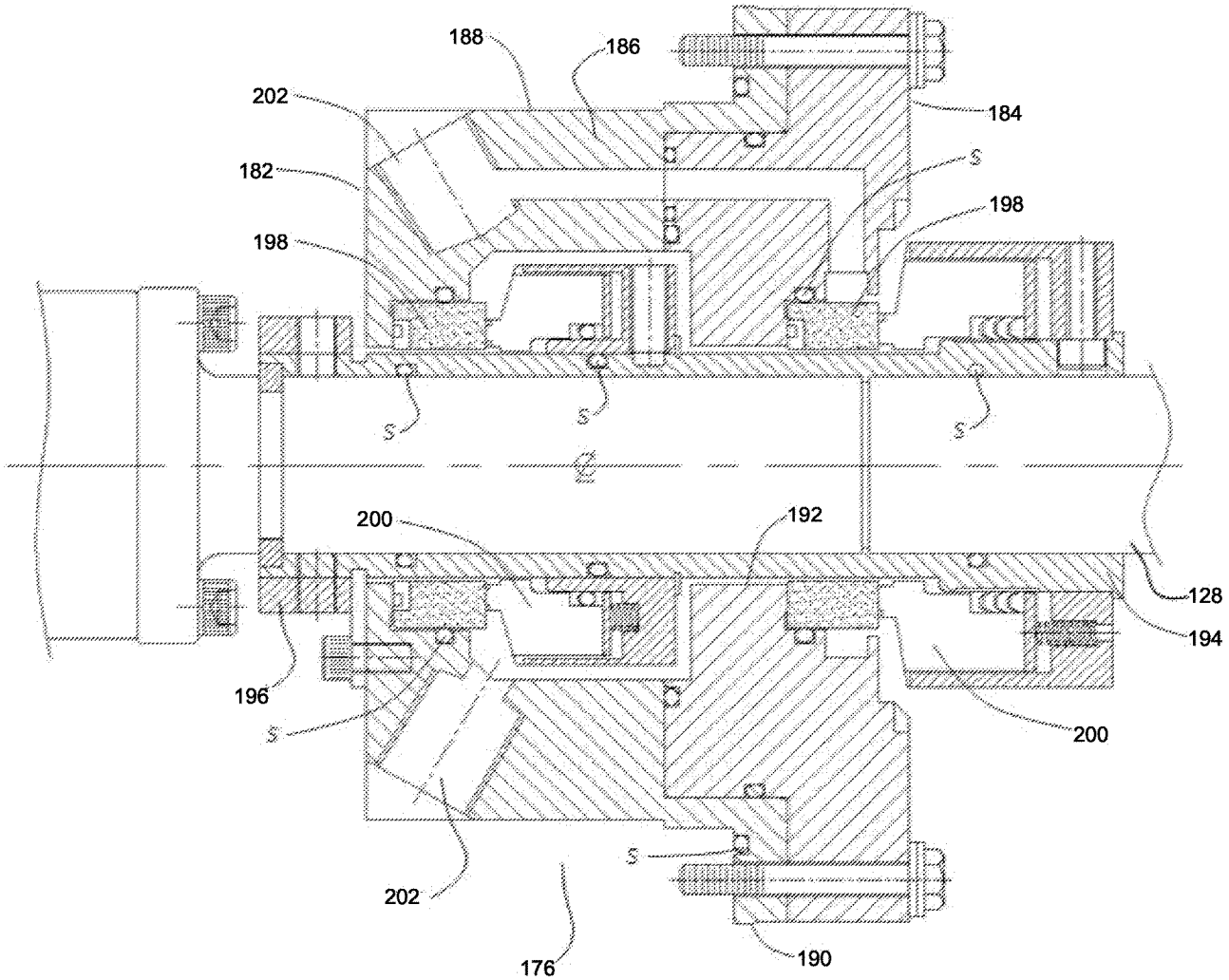
FIG. 7 is a cross-sectional view of a cartridge seal assembly constructed in accordance with a presently preferred embodiment.

Turning back to FIG. 7, shown therein is the cartridge seal assembly 176 constructed in accordance with a preferred embodiment. The cartridge seal assembly 176 includes a seal motor end 182 and a seal pump end 184. The cartridge seal assembly 176 may include a seal body, or gland 186. The gland has a minor gland diameter 188, a major gland diameter 190 and an inner gland diameter 192. A seal sleeve 194 is mounted around a drive shaft segment 128 and includes a drive collar 196. The drive shaft segment 128 and seal sleeve 194 are concentric to the inner gland diameter 190. The cartridge seal assembly 176 may contain one or more stationary rings 198, one or more rotating rings 200, a plurality of O-ring seals "S," and other miscellaneous additional sealing and retaining devices (not separately designated). The seal motor end 182 of the cartridge seal assembly 176 also includes gland connections 202 to allow barrier fluid to be circulated through an external reservoir or to allow cooling fluid to be extracted from the discharge side of the pump 106.

Figure 8:
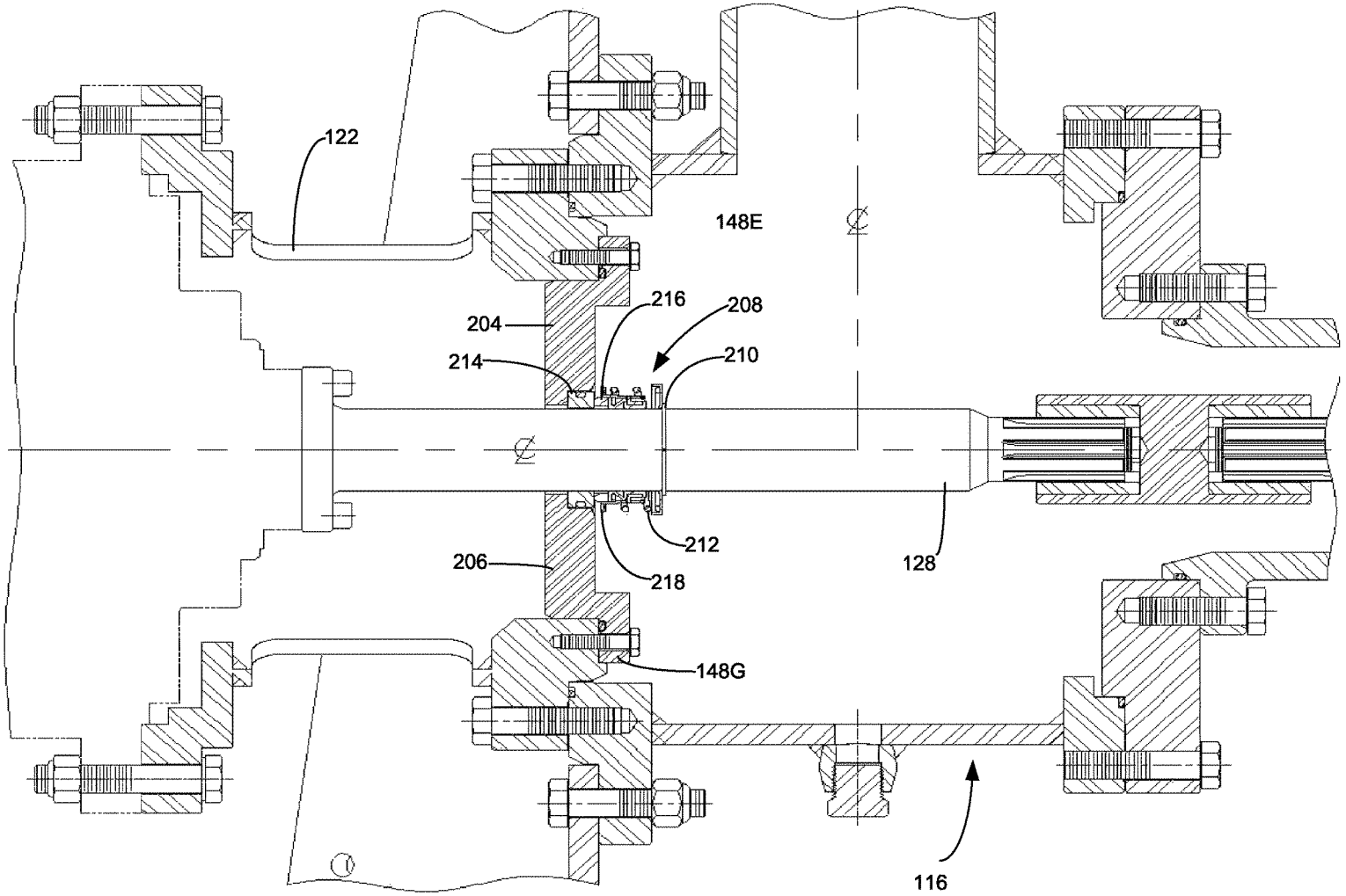
FIG. 8 is a cross-sectional view of a suction chamber assembly constructed in accordance with a presently preferred embodiment and including a component seal assembly.

Turning to FIG. 8, shown therein is a preferred embodiment of the suction chamber assembly 116 incorporating a component seal assembly 204. The component seal assembly 204 includes a component seal plate 206 and a mechanical seal 208. The mechanical seal 208 includes a snap ring 210, a seal spring 212, a stationary ring 214, a rotary ring 216, a seal retainer 218 and other miscellaneous, mostly elastomeric sealing and retaining devices. The component seal assembly 204 is connected to the bearing chamber adapter 122 by sliding the component seal plate 206 into the second adapter mating surface 148G against the second adapter shoulder 148E of the adapter end plate 148 of the bearing chamber adapter 122, and then secured via welding, fasteners or by other means known in the art. An O-ring, sealing device or other suitable device known in the art, is positioned between the second adapter mating surface 148G of the adapter pump end plate 148 and the component seal assembly 204.

Figure 9:
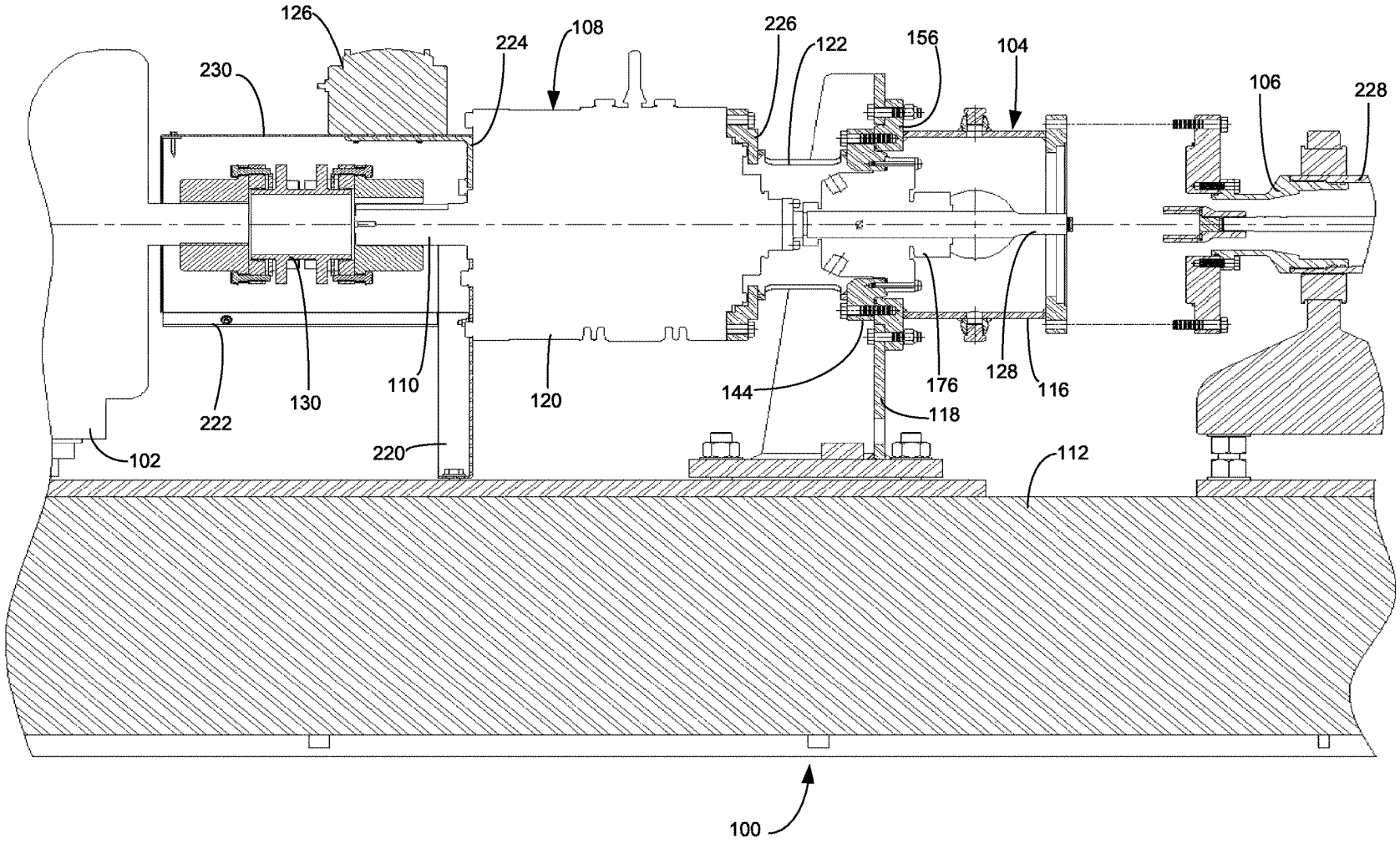
FIG. 9 is a cross-sectional view of the horizontal pumping system constructed in accordance with a presently preferred embodiment.

Referring now to FIG. 9, shown therein is a cross sectional view of a preferred embodiment of the horizontal pumping system 100. From a functional perspective, the horizontal pumping system 100 has a wet side 228 and a dry side 230. The wet side 228 is located at the suction chamber motor end 156 of the suction chamber 116 and extends to the discharge end 134 (not shown in FIG. 9) of the pump 106. The dry side 230 of the horizontal pumping system 100 begins at the bearing chamber adapter pump end 144 of the bearing chamber adapter 122 and extends to the motor 102. The vertical bracket 118 is attached to the platform 112 through welding, fasteners or other means known in the art (bolts are shown). The thrust bearing assembly 108 includes a thrust bearing chamber bracket 220 that supports the motor end of the thrust bearing chamber 120. In the embodiment depicted in FIG. 9, a coupling cover 222 surrounds the shaft couplings 130 and is connected to the thrust bearing chamber 108. The coupling cover 222 isolates the coupling 130 from environmental conditions. The vibration sensor 126 is preferably fastened to, and supported by, the coupling cover 222. The thrust bearing assembly 108 further includes a thrust bearing chamber motor end 224 and a thrust bearing chamber pump end 226.

Figure 10:
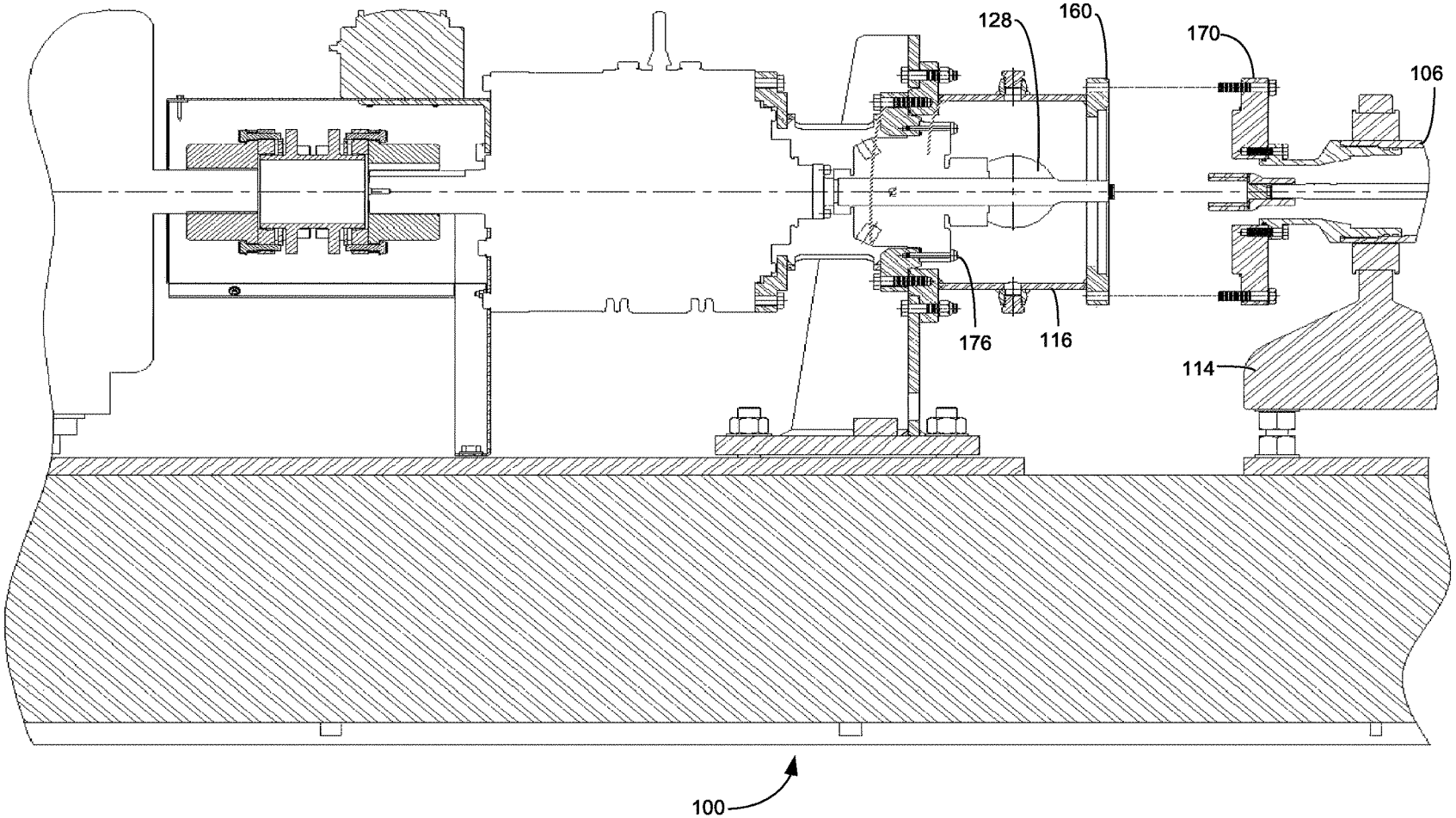
FIG. 10 is a cross-sectional view of the horizontal pumping system of FIG. 9 shown with pump end seal removal in process.

Now turning to FIG. 10, shown therein is the horizontal pumping system 100 undergoing a pump end seal access operation. The pump 106 has been disengaged from the one or more pump supports 114, and the pump adapter plate 170 has been disengaged from the pump end plate 160 of the suction chamber 116. The discharge end 134 (not depicted in FIG. 10) of the pump 106 has also been disconnected from the discharge head 136 (not depicted in FIG. 10) and the drop off element 138 (not depicted in FIG. 10). The pump 106 and pump adapter plate 170 are then moved away from the motor 102 and out of the way to create the necessary space to remove the cartridge seal assembly 176.

It will be understood that although the cartridge seal assembly 176 is shown, the horizontal pumping system 100 could alternatively include the component seal assembly 204. Prior to removal or service of the component seal assembly 204 the snap ring 210 of the component seal 204 must be removed from the drive shaft segment 128. Alternatively, the mechanical seal 208 of the component seal assembly 204 may be removed and replaced if removal of the entire component seal assembly 204 is not necessary.

Thus, in preferred embodiments, the pump end plate 160 of the suction chamber 116 may be easily disengaged and moved away from the suction chamber 116 to obtain access to the interior of the suction chamber 116 through the pump end of the suction chamber 116. Once access to the interior of the suction chamber 116 has been gained through the pump end thereof, the sealing assembly will simply slide off of the drive shaft segment 128.

Figure 11:
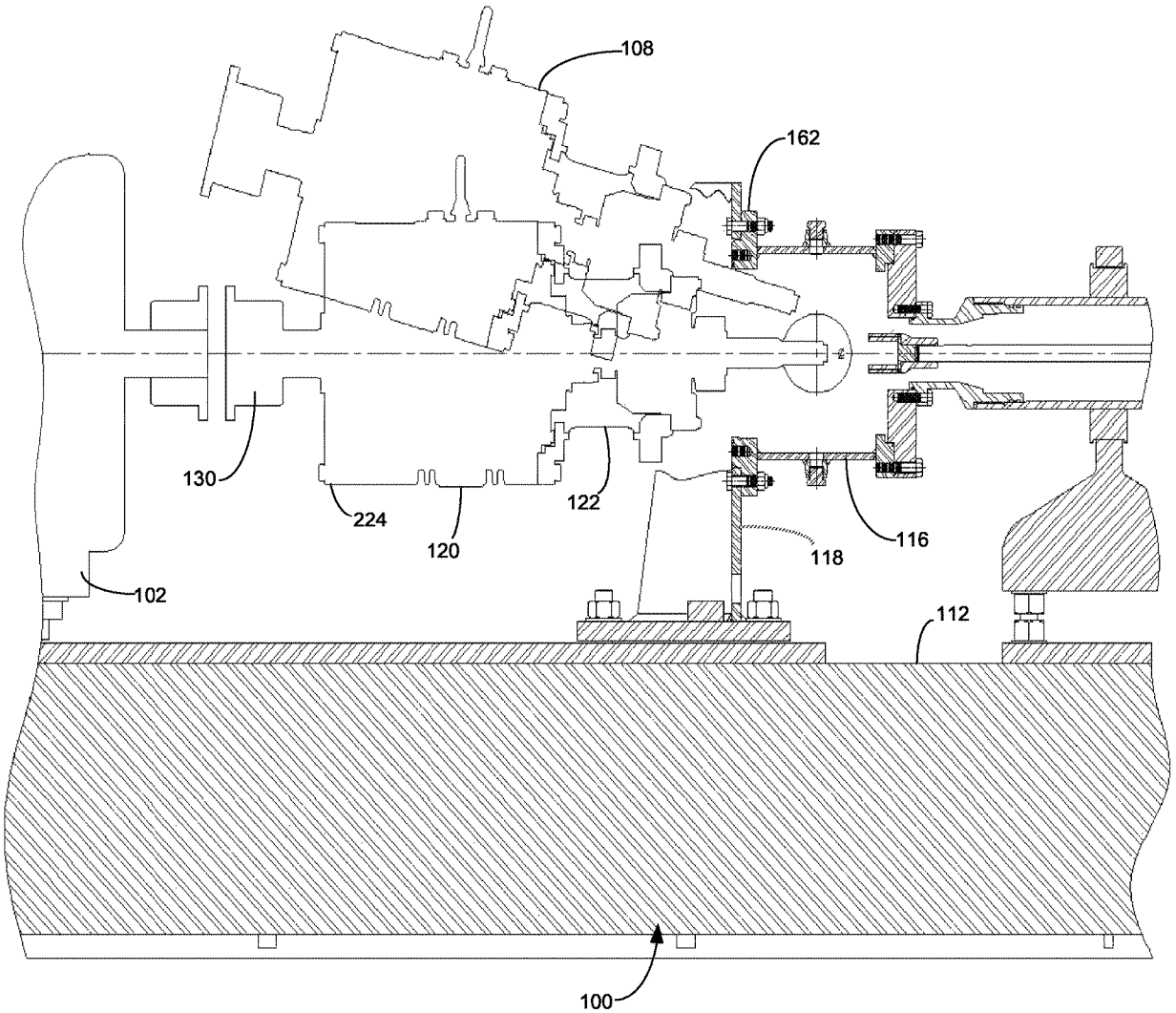
FIG. 11 is a cross-sectional view of the horizontal pumping system of FIG. 9 shown with motor end seal removal in process.

Now referring to FIG. 11, shown therein is the horizontal pumping system 100 wherein seal motor end removal is in progress. The coupling cover 222 and vibration sensor 126 (as depicted in FIG. 9) have been removed. The thrust bearing chamber bracket 220 has been disengaged from the platform 112. It will be understood that the thrust bearing chamber bracket 220 may also be disengaged from the thrust bearing chamber motor end 224 of the thrust bearing chamber 120, or alternatively, the thrust bearing chamber bracket 220 may remain attached to the thrust bearing chamber 120 during the seal motor end removal process.

To create the necessary space to remove the thrust bearing assembly 108 from the horizontal pumping system 100, the one or more couplings 130 are removed and the adapter pump end plate 148 of the bearing chamber adapter 122 is disengaged from the motor end plate 162 of the suction chamber 116. The thrust bearing assembly 108 is then able to be removed from the horizontal pumping system 100. This process allows access for servicing and/or removal of the cartridge seal assembly 176. Removal of the cartridge seal assembly 176 requires it to be disengaged from the bearing chamber adapter 122 and slid along the at least one of the drive shaft segments 128. It will be understood that although the cartridge seal assembly 176 is shown, the horizontal pumping system 100 could include the component seal assembly 204 in place of the cartridge seal assembly 176.

Figure 13:
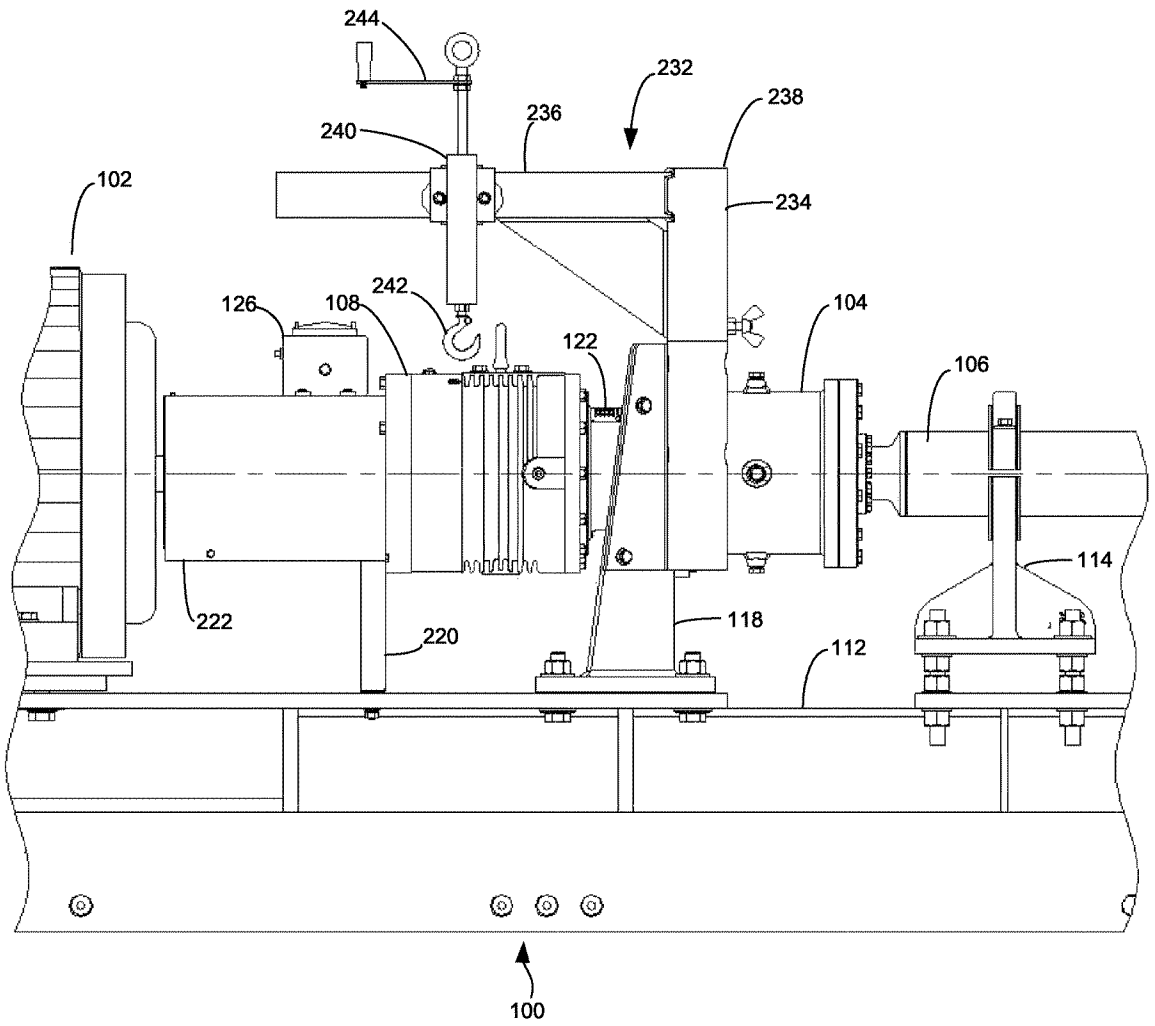
FIG. 13 is a side view of the horizontal pumping system constructed in accordance with a presently preferred embodiment.

Now referring to FIG. 13, shown therein is the horizontal pumping system 100 including an integrated lifting device 232 for assisting in the lifting or removal of the thrust bearing assembly 108 from the horizontal pumping system 100 for seal motor end service/removal. The integrated lifting device 232 includes a first member 234 mounted to the vertical bracket 118. The integrated lifting device 232 also includes a second member 236 connected to the first member 234 and capable of pivoting around the first member 234 at a pivot point 238. The integrated lifting device also includes a trolley 240 which is capable of sliding along, and removable from, the second member 236. The trolley 240 includes a lifting member 242 and a crank 244 for lowering and raising the lifting member 242. The lifting member 242 may be connected to the thrust bearing assembly 108 for lifting and/or removing the thrust bearing assembly 108 from the horizontal pumping system 100.

Figure 14:
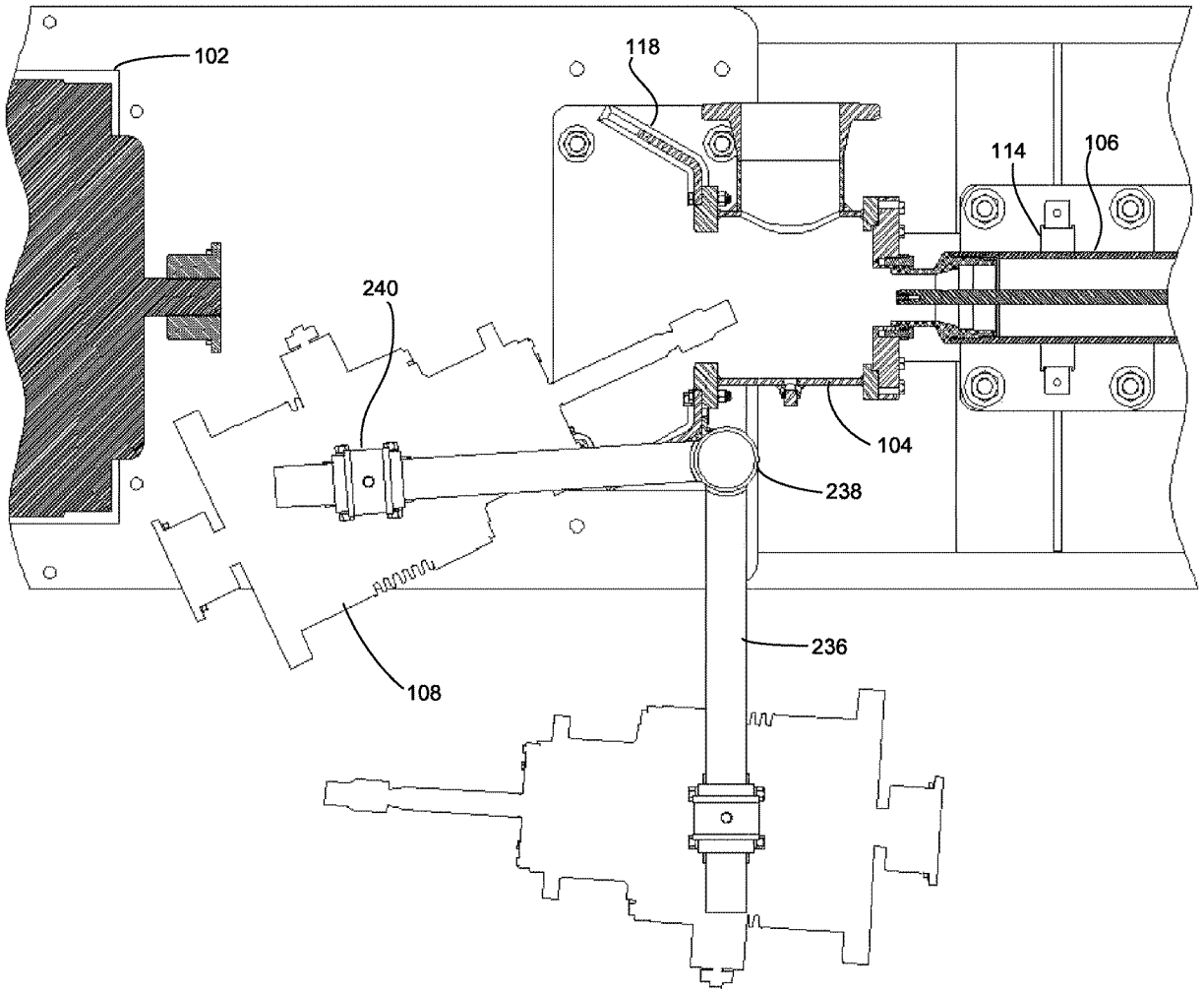
FIG. 14 is a top view of the horizontal pumping system of FIG. 13.

Referring more specifically to FIG. 14, depicted therein is a top view of the horizontal pumping system 100 of FIG. 13 showing the removal of the thrust bearing assembly 108 utilizing the integrated lifting device 232. The thrust bearing assembly 108 has been connected to the integrated lifting device 232 and the second member 236 has pivoted about the pivot point 238 to remove the thrust bearing assembly 108 from its position between the motor 102 and the suction chamber assembly 104.

Thus, the preferred embodiments provide for a pumping system 100 that permits facilitated access to the suction chamber 116 from both the pump end and motor end of the suction chamber 116. Furthermore, because the suction chamber 116 remains fixed to the vertical bracket 118, the risk of misalignment generated by loads acting on the suction chamber inlet flange are significantly reduced. This represents an improvement over the prior art and improves the operating life of the pumping system 100 by reducing vibration after servicing the seal assembly. Additionally, the inclusion of the integrated lifting device 232 connected to the vertical bracket 118 provides a low cost, easy solution for lifting and/or removing the thrust bearing assembly 108 for motor end seal access.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A horizontal pumping system comprising:
- a motor;
- a pump driven by the motor;
- a platform;
- a thrust bearing assembly connected to the motor;
- a suction chamber assembly, wherein the suction chamber assembly comprises:
  - a vertical bracket extending from the platform;
  - a suction chamber connected to the pump and supported by the vertical bracket, wherein the suction chamber includes a motor-end plate that has a central opening;
- a bearing chamber adapter connected between the thrust bearing assembly and the suction chamber, wherein the bearing chamber adapter comprises an adapter pump-end plate removably attached to the motor-end plate of the suction chamber with fasteners that are accessible from outside the suction chamber;
- a seal assembly inside the suction chamber, wherein the seal assembly is removably connected to the adapter pump-end plate of the bearing chamber adapter with fasteners that are accessible from inside the suction chamber; and
- wherein the seal assembly is sized to be removed from the suction chamber through the central opening of the motor-end plate of the suction chamber when the adapter pump-end plate is removed from the motor-end plate.

2. The horizontal pumping system of claim 1, wherein the suction chamber further comprises a pump end plate connected to the pump.

3. The horizontal pumping system of claim 2, wherein the pump end plate is removable from the pump.

4. The horizontal pumping system of claim 1 further comprising:
- an integrated lifting device connected to the vertical bracket and configured to remove the thrust bearing assembly from the horizontal pumping system to provide access to the seal assembly in the suction chamber.

5. The horizontal pumping system of claim 4, wherein the integrated lifting device comprises:
- a first member connected to the vertical bracket;

a second member connected to the first member at a pivot point, wherein the second member is capable of pivoted rotation about the first member; and a trolley slideably engaged with, and removable from, the second member.

6. The horizontal pumping system of claim 5, wherein the trolley further comprises:

a lifting member; and a mechanism for lowering and raising the lifting member.

7. The horizontal pumping system of claim 6, wherein the mechanism for lowering and raising the lifting member comprises a crank attached to the lifting member.

8. The horizontal pumping system of claim 6, wherein the thrust bearing assembly may be lifted or removed from the horizontal pumping system utilizing the integrated lifting device.

9. A horizontal pumping system comprising:

one or more platforms;

a motor supported by the one or more platforms;

a pump supported by the one or more platforms;

a vertical bracket supported by the one or more platforms;

a suction chamber connected between the pump and mounted directly to and supportable by the vertical bracket, wherein the suction chamber includes a motor-end plate that has a central opening;

a thrust bearing assembly, the thrust bearing assembly comprising:

a thrust bearing chamber connected to the motor;

a bearing chamber adapter connected between the thrust bearing chamber and the suction chamber assembly, wherein the bearing chamber adapter includes an adapter pump-end plate that is removably connected to the suction chamber; and a thrust bearing chamber bracket supported by the platform and connected to the thrust bearing assembly;

a seal assembly, wherein the seal assembly is removably connected to the adapter pump-end plate of the bearing chamber adapter with fasteners that are accessible from inside the suction chamber; and wherein the seal assembly is sized to be removed from the suction chamber through the central opening of the motor-end plate of the suction chamber when the adapter pump-end plate is removed from the motor-end plate.

10. The horizontal pumping system of claim 9, wherein the pump is removably connected to the suction chamber.

11. A horizontal pumping system comprising:

a motor;

a pump driven by the motor;

a thrust bearing assembly connected to the motor;

a suction chamber assembly, wherein the suction chamber assembly comprises:

a suction chamber connected to the pump, wherein the suction chamber includes a motor-end plate that has a central opening; and a seal contained within the suction chamber, wherein the seal has a seal body with a greatest outer diameter and wherein the greatest outer diameter of the seal body is smaller than the central opening of the motor-end plate; and a bearing chamber adapter connected between the thrust bearing assembly and the suction chamber, wherein the bearing chamber adapter comprises an adapter pump-end plate removably attached to the motor-end plate of the suction chamber with fasteners that are accessible from outside the suction chamber and wherein the seal body is connected to the adapter pump-end plate with fasteners that are accessible from inside the suction chamber.

12. The horizontal pumping system of claim 11, wherein the seal is a cartridge seal assembly within the suction chamber assembly.

13. The horizontal pumping system of claim 11, wherein the seal is a component seal assembly within the suction chamber assembly.

14. The horizontal pumping system of claim 11, wherein the suction chamber assembly further comprises:

an inlet pipe; and a nozzle.

* * * * *